US005547190A

United States Patent [19]

Mackewich, Jr. et al.

[11] Patent Number: 5,547,190

[45] Date of Patent: Aug. 20, 1996

[54] LIGHTED NUNCHAKUS

[76] Inventors: Frank A. Mackewich, Jr., 1522 Scenic Dr.; Herman J. Luette, III, 904 S. Florida #40, both of Alamogordo, N.M. 88310

[21] Appl. No.: 515,669

[22] Filed: Aug. 16, 1995

[51] Int. Cl.[6] ..... F41B 15/02

[52] U.S. Cl. ..... 273/84 R; 362/102

[58] Field of Search ..... 273/84 R, 84 ES, 273/84 A, DIG. 24; 362/102

[56] References Cited

U.S. PATENT DOCUMENTS

| | | | |
|---|---|---|---|
| 1,066,540 | 7/1913 | Smithwick . | |
| 1,130,355 | 3/1915 | Von Eschen et al. . | |
| 3,454,274 | 7/1969 | Kaneshiro | 272/76 |
| 4,070,023 | 1/1978 | Culter | 273/84 |
| 4,529,193 | 7/1985 | Kuhnsman | 482/82 |
| 4,776,585 | 10/1988 | Maleyko et al. | 482/82 |
| 5,087,034 | 2/1992 | Solis | 482/82 |
| 5,389,056 | 2/1995 | Ricker | 482/82 |

OTHER PUBLICATIONS

"Black Belt", Soft Nunchaku, p. 69, Feb. 1978.

*Primary Examiner*—William M. Pierce
*Attorney, Agent, or Firm*—Dennis F. Armijo

[57] ABSTRACT

Lighted nunchakus with a light source contained within a transparent nunchaku. The light source can be a light bulb with a power source or a chemically activated light. In addition, foam rubber nunchakus and foam rubber coated nunchakus are disclosed.

14 Claims, 4 Drawing Sheets

LIGHTED NUNCHAKUS

BACKGROUND OF THE INVENTION

1. Field of the Invention (Technical Field)

The invention relates to martial arts lighted nunchakus with self-contained power and light sources and foam rubber nunchakus.

2. Background Art

Nunchakus are an ancient martial arts fighting weapon. Nunchakus are used in the martial arts for fighting or demonstration purposes. The user swings the nunchakus by the bottom of one of the handles (nunchaku) in a predetermined form or "kata". Most nunchakus are comprised of a pair of 12 to 14 inch handles interconnected with a cord or chain at an end of each handle.

Several improvements to the original wooden nunchakus have been utilized and disclosed in the prior art. U.S. Pat. No. 4,070,023 to Cutler, discloses a nunchaku constructed from perforated metal with an adjustable securing device for attachment to a rope.

U.S. Pat. No. 3,454,274 discloses a toy striking stick comprising two similar handles attached to a cord. Additionally, there is disclosed a spherical noisemaker or rattling member affixed to each handle.

None of the prior art, however, discloses light emitting or illuminated nunchakus or foam rubber nunchakus.

SUMMARY OF THE INVENTION (DISCLOSURE OF THE INVENTION)

In accordance with the present invention there is provided nunchakus with an internal light source for enhancing the visual aspects of their utilization. The preferred lighted nunchakus comprises a first and a second handle with an end portion of each of the handles affixed to a cord wherein at least one of the handles comprises a light emitting apparatus.

The preferred light emitting apparatus comprises a member selected from the group consisting of incandescent light bulbs, fluorescent light bulbs, halogen lights and light emitting diodes. The light emitting apparatus further comprises a power source. The preferred power source further comprises a power switch. The alternative light emitting apparatus comprises a chemically activated light. The light emitting apparatus can also comprise a plurality of lights.

The preferred at least one of the handles comprise a transparent material. The alternative at least one of the handles comprise apertures for permitting light rays from the light emitting apparatus to radiate out of the at least one of the handles.

The alternative light emitting apparatus further comprises a reflecting surface for reflecting light rays from the light emitting apparatus. The alternative reflecting surface comprises a rotating ball. The alternative light emitting apparatus further comprises a refracting surface for refracting light rays from the light emitting apparatus. The alternative light emitting apparatus can also comprise a rotating light emitting apparatus.

The preferred foam rubber nunchakus comprise a first and a second handle with an end portion of each of the handles affixed to a cord wherein each of the handles comprises foam rubber. The preferred handles further comprise a rigid material beneath the foam rubber. The alternative handles comprise a light emitting apparatus.

A primary object of the present invention is the provision of internally lighted nunchakus.

Another object of the invention is the provision of a safe set of practice or toy foam rubber nunchakus.

A primary advantage of the present invention is its enhancement of the visual presentation of utilizing nunchakus.

Another advantage of the present invention is its low cost and ease of manufacture.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

Nunchakus, a martial arts weapon, are used for fighting and demonstration purposes. Nunchakus have been used as a self-defense weapon for hundreds of years. A user holds one of the nunchaku in one hand and swings the second handle, which is attached by a cord, in different patterns. Skilled users can swing the nunchakus at tremendous velocities. Training for the skilled use of nunchakus takes patience, time and dedication. The use of the disclosed invention enhances the user's desire to swing the nunchakus and also enhances the visual presentation of a demonstration of a "kata".

Figure 1:
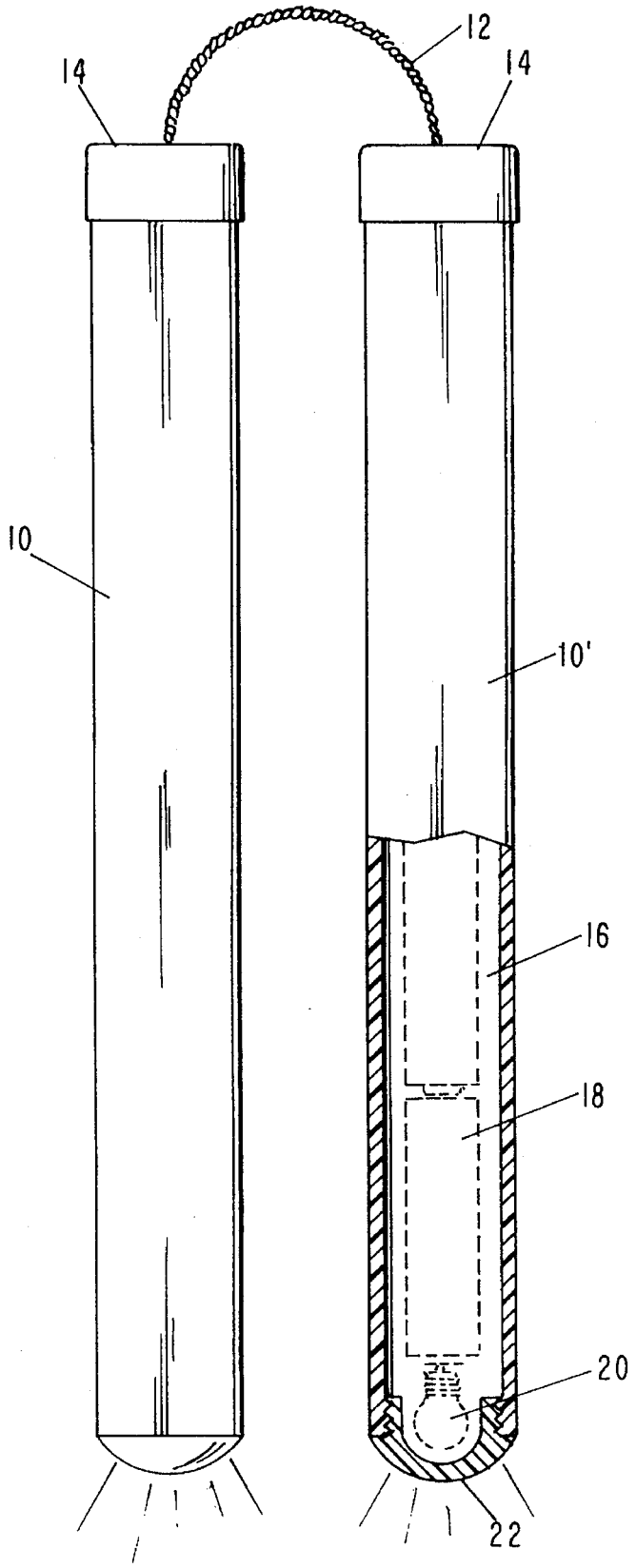
FIG. 1 depicts the preferred embodiment of the invention.

FIG. 1 shows the preferred end light embodiment of the invention. Handle 10 is made of any hard material such as wood, plastic or metal. Handle 10 is a tubular member attached to second handle 10' with string or cord 12. Optional end caps 14 can be attached to handles 10 and 10' for securing cord 12. End caps 14 can be threaded, glued or attached by other well known means, to handles 10 and 10'. Cord 12 is affixed to end caps 14 with a knot or the like. Cord 12 can be directly affixed to handles 10 and 10' by manufacturing handles 10 and 10' with an enclosed end and a cord 12 affixing structure (not shown). Within the hollow portion 16 of handles 10 and 10' is power source 18 (such as batteries) and light source 20. These components are secured within hollow portion 16 to be free of movement when the nunchaku is swung. This can be accomplished with molding cages or apertures for these components in the manufacture of handles 10 and 10' or by utilizing holding structures such as cardboard, foam rubber or the like (not shown). Optional lens 22 can be provided for protection of light source 20, as shown.

Figure 2:
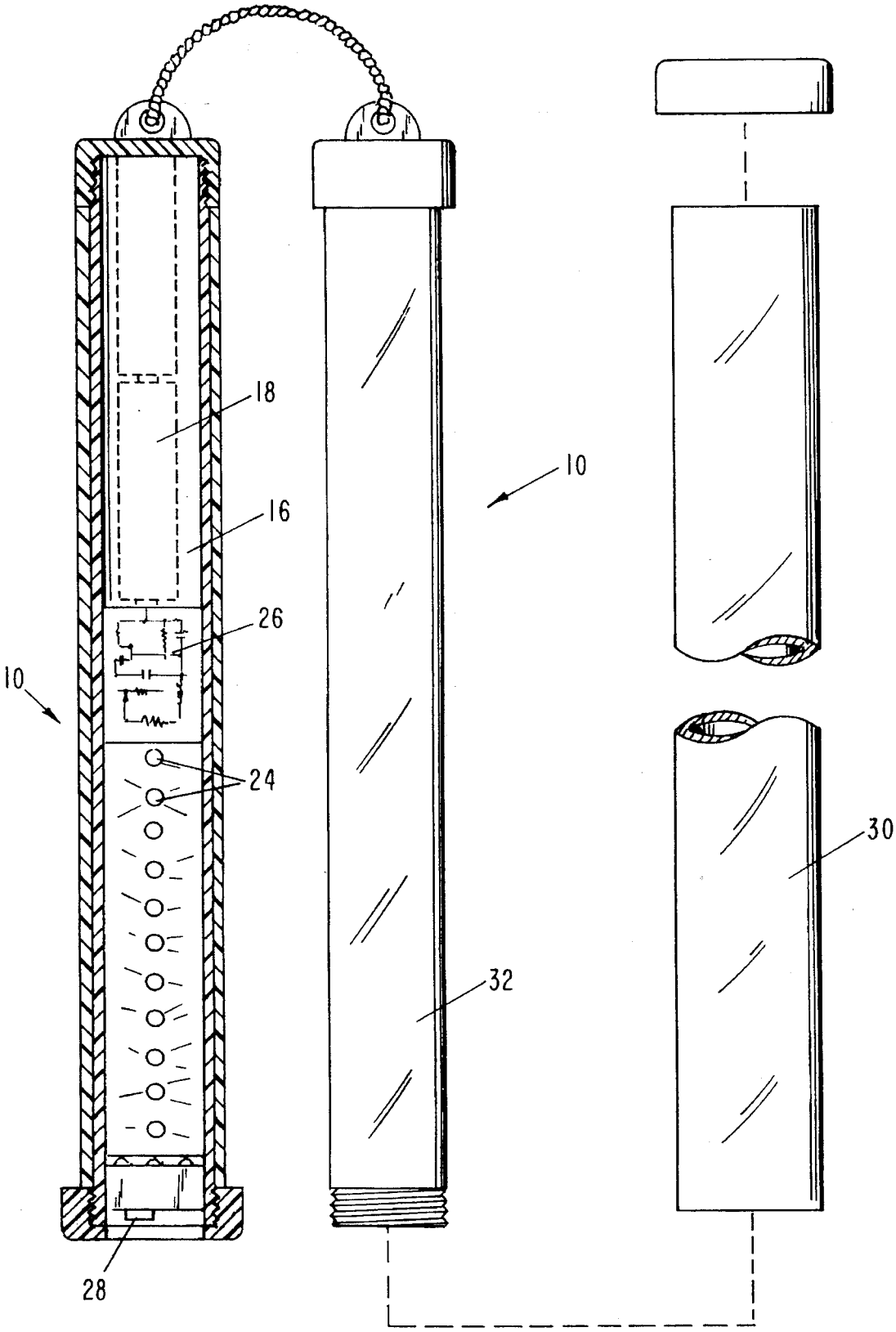
FIG. 2 shows the preferred multi-light embodiment of the invention.

FIG. 2 shows the preferred multi-light embodiment. In this embodiment, one or more light sources 24 are positioned within handle 10. Handle 10 in this embodiment is preferably a clear or colored plastic material to allow light to fully or partially radiate through it. Alternatively, handle 10 can have apertures located near or directly over light sources 24 to allow the light to radiate out of handle 10. In this embodiment, light sources 24 can blink, chase or the like. Electronic circuitry 26, for the various aforementioned lighting variations, is contained within hollow portion 16 along with light sources 24 and power source 18. On/off switch 28 can be placed on each handle 10 as shown or in any other accessible location. Any type of switch can be utilized including, but not limited to slide switches, toggle switches or foil switches. Although on/off switch 28 is shown only in this embodiment, it can be placed on all of the embodiments of this invention. In addition to a manually operated switch to supply power from power source 18 to light sources 24, a gravitational switch, which is well known in the art, could be placed in hollow portion 16, which is activated when the nunchakus are swung. As in the embodiment of FIG. 1, a structure for holding components in position within handle 10, should be used. Light sources 24, in any of the embodiments can be filament bulbs, light emitting diodes, gas filled neon lights, or the like.

To further enhance the lighted effect of the nunchakus, an insert 30 can be placed on inner wall 32 of handle 10. Insert 30 can be made of paper, cardboard, plastic, or the like. Insert 30 can contain printed advertising, shaped apertures to allow radiated light to escape, or colored transparent material to add color to the radiated light. Insert 30 can be wedged against inner wall 32, or for easy removal could be inserted between a double inner wall with a void in the middle (not shown).

Figure 3:
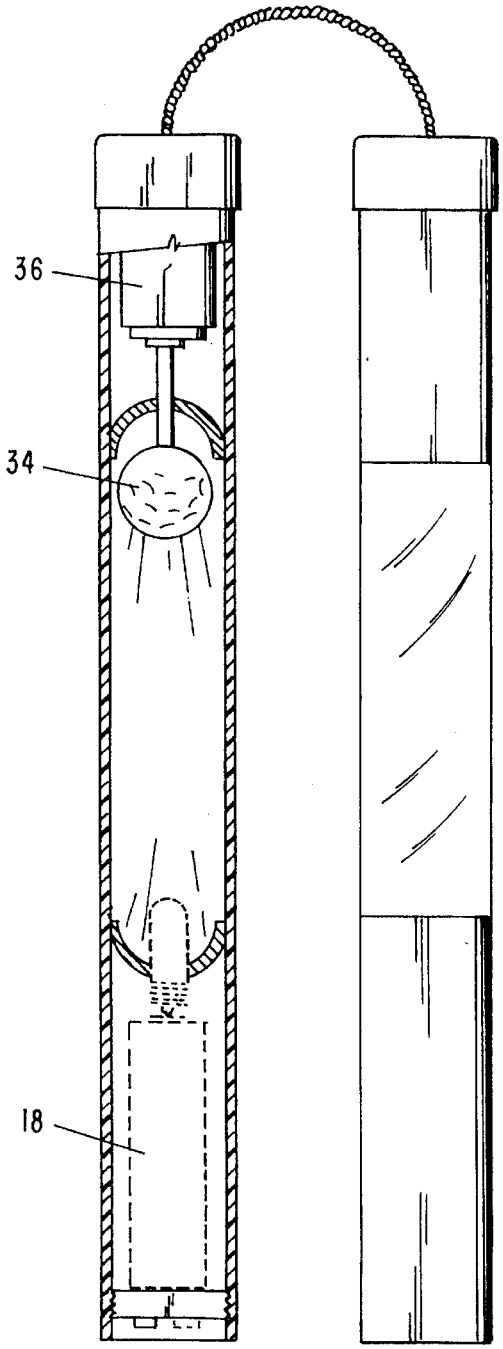
FIG. 3 shows the alternative spinning ball embodiment of the invention.

FIG. 3 shows another embodiment of the lighted nunchakus. In this embodiment, the light rays are reflected off a spinning ball 34. The surface of spinning ball 34 can be a faceted mirror surface or the like. Spinning ball 34 is revolved via motor 36, which is powered by power source 18. In the alternative, the light source 22 can be revolved (not shown) via motor 36.

Figure 4:
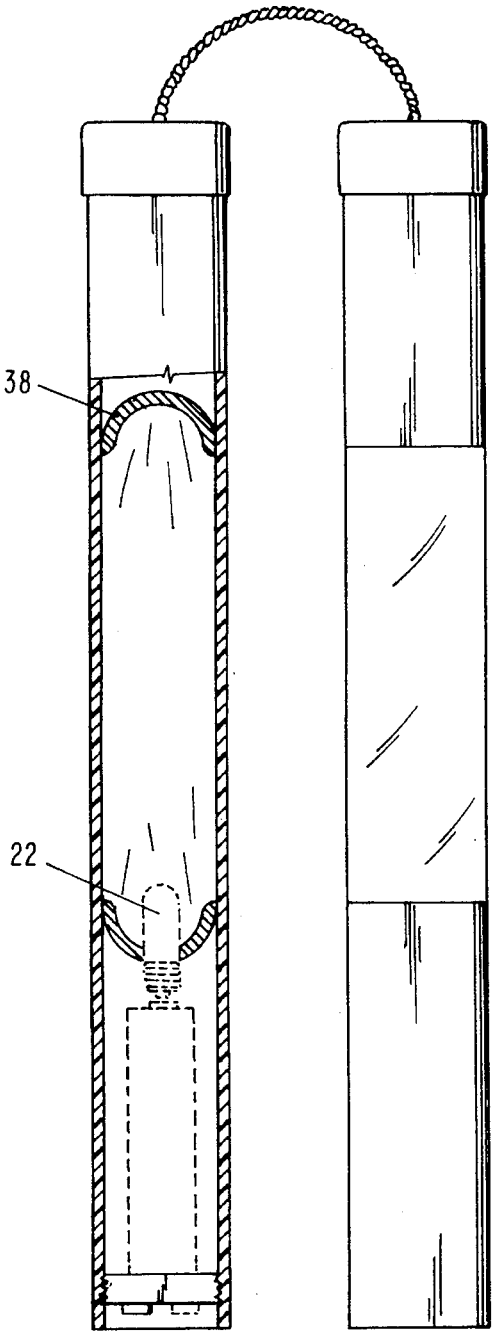
FIG. 4 shows the reflective or refractive surface embodiment of the invention.

FIG. 4 is yet another embodiment in which the light rays from light source 22 are directed towards refracting or reflecting surface 38. This surface 38 can also be of a mirror faceted material or the like.

Figure 5:
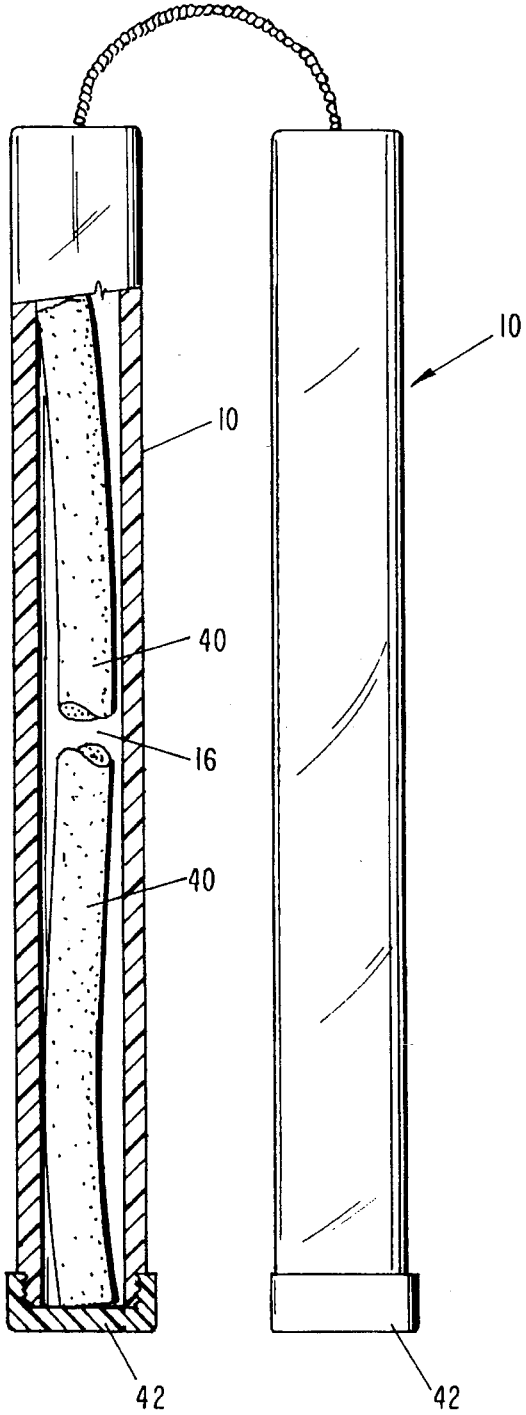
FIG. 5 shows the alternative embodiment with a chemically activated light tube.

FIG. 5 is yet another alternative embodiment of the invention. In this embodiment a chemically activated light tube 40, which is well known in the art, is activated and inserted into hollow portion 16. End cap 42 is screwed, snapped, or the like, onto handle 10 to keep chemically activated light tube 40 within hollow portion 16.

Figure 6:
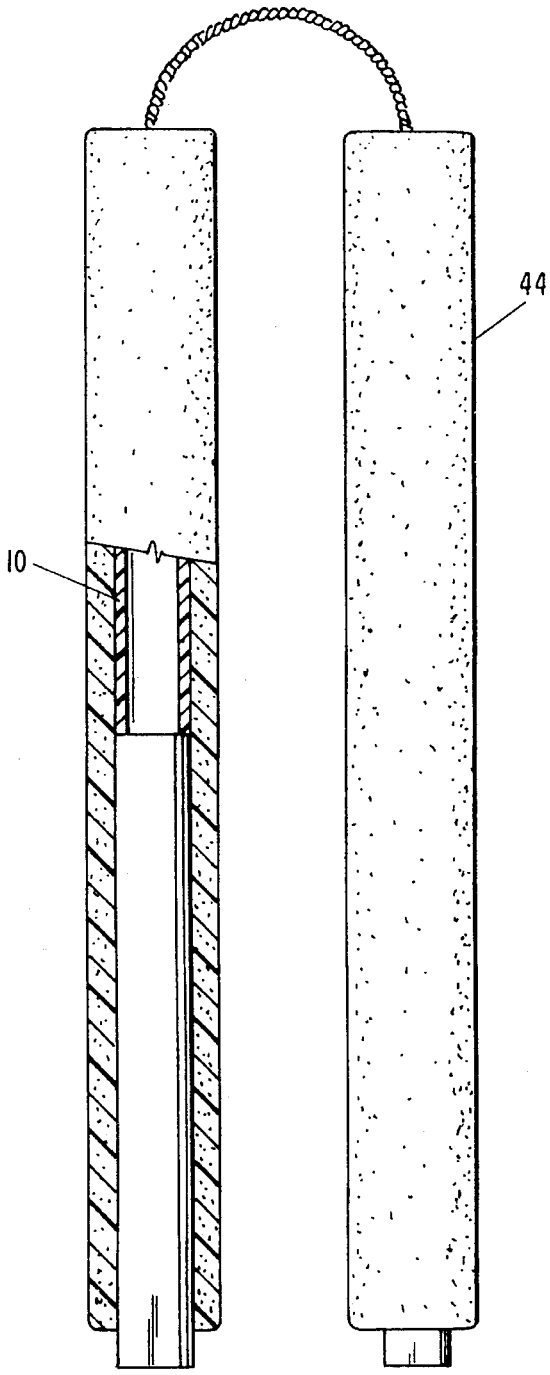
FIG. 6 shows the preferred foam rubber embodiment of the invention.

FIG. 6 shows a foam rubber embodiment of the invention. In this embodiment a foam rubber outer cover 44 is affixed to handle 10 or, in the alternative, the entire nunchaku can be made of foam rubber. This embodiment can provide safety for beginners in the art or could be used as a toy for children. A power source and light source can also be provided in this embodiment as previously described (not shown).

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application(s), are hereby incorporated by reference.

What is claimed is:

1. A martial arts nunchakus comprising:

a first and second elongated handle portions each having a first and second end portion and a hollow interior portion with said first end portion of each of said handles affixed to a substantially non-elastic cord wherein at least one of said handles comprises a light emitting apparatus in said hollow interior and further having a means for allowing light to radiate through said handle portion or through said second end.

2. The invention of claim 1 wherein said light emitting apparatus comprises a member selected from the group consisting of incandescent light bulbs, fluorescent light bulbs, halogen lights and light emitting diodes.

3. The invention of claim 1 wherein said light emitting apparatus further comprises a power source.

4. The invention of claim 2 further comprising a power switch.

5. The invention of claim 1 wherein said light emitting apparatus comprises a chemically activated light.

6. The invention of claim 1 wherein said light emitting apparatus comprises a plurality of lights.

7. The invention of claim 1 wherein said means for allowing light to radiate through said handle portion or through said second end comprises a transparent material.

8. The invention of claim 1 wherein means for allowing light to radiate through said handle portion or through said second end comprises apertures for permitting light rays from said light emitting apparatus to radiate out of said at least one of said handles.

9. The invention of claim 1 wherein said light emitting apparatus further comprises a reflecting surface for reflecting light rays from said light emitting apparatus.

10. The invention of claim 9 wherein said reflecting surface comprises a rotating ball.

11. The invention of claim 1 wherein said light emitting apparatus further comprises a refracting surface for refracting light rays from said light emitting apparatus.

12. The invention of claim 1 wherein said light emitting apparatus comprises a rotating light emitting apparatus.

13. The invention of claim 1 wherein said first and second handles comprise foam rubber.

14. The invention of claim 13 wherein said first and second handles further comprise a rigid material beneath said foam rubber.

* * * * *